United States Patent [19]

McKee

[11] 4,268,228

[45] May 19, 1981

[54] HYDRAULIC PUMPING UNIT

[75] Inventor: Fount E. McKee, Houston, Tex.

[73] Assignee: Delta-X Corporation, Houston, Tex.

[21] Appl. No.: 65,813

[22] Filed: Aug. 13, 1979

[51] Int. Cl.[3] ..... F04B 9/10

[52] U.S. Cl. ..... 417/390; 60/413; 60/371; 91/189 R; 91/452; 91/517; 91/518

[58] Field of Search ..... 417/401, 390, 399, 342; 60/413, 372, 371; 91/189 R, 420, 452, 517, 518, 520

[56] References Cited

U.S. PATENT DOCUMENTS

| | | | |
|---|---|---|---|
| 2,313,405 | 3/1943 | Vickers | 417/342 X |
| 3,632,234 | 1/1972 | Lake | 417/390 |
| 3,778,193 | 12/1973 | Reinert | 417/342 X |

*Primary Examiner*—Leonard E. Smith
*Attorney, Agent, or Firm*—Fulbright & Jaworski

[57] ABSTRACT

A hydraulic pumping unit for vertically actuating a downhole pump including first and second hydraulic piston and cylinder assemblies. The first assembly is connected to the downhole pump and the second assembly is connected to a counterweight. A hydraulic line is connected between the first and second assemblies so that the counterweight counterbalances the downhole pumping equipment. A hydraulic pump is connected to the first and second assemblies through switching means for alternately supplying hydraulic fluid to and from the first and second assemblies. A check valve is provided between the hydraulic pump and the hydraulic line for replenishing the assemblies with fluid. A safety valve is connected between the first assembly and the hydraulic line for preventing the first assembly dropping in the event of a hydraulic line failure. A return valve in parallel with an orifice closes in the event the hydraulic pump stops for preventing free fall of the first assembly. A pressure switch connected to the second assembly insures that hydraulic fluid is supplied into the first cylinder to prevent actuation of the check filling valve on each stroke.

6 Claims, 3 Drawing Figures

HYDRAULIC PUMPING UNIT

BACKGROUND OF THE INVENTION

Various types of pumping units have been utilized to pump oil from the ground by vertically reciprocating a polished rod which lifts a rod string and actuates a downhole pump. Typically a walking beam is powered about its center with one end connected to the polished rod and the second end having a counterweight. However, the load presented to the prime mover in actuating the walking beam is cyclic and is not constant.

The present invention overcomes the disadvantages of the prior art pumping units by providing a hydraulic pumping unit having a linear counterbalance and allows the power requirements to be substantially constant throughout the pumping stroke. In addition, a hydraulic and electrical control circuit provides reliable control and actuation of the pumping unit.

SUMMARY

The present invention is directed to a hydraulic pumping unit for vertically actuating a downhole pump and includes first and second hydraulic piston and cylinder assemblies. The first assembly is adapted to be connected to and actuates the downhole pump. The second assembly is connected to a counterweight. A hydraulic connection between the first and second assemblies allows the counterweight to hydraulically counterbalance the pump load carried by the first assembly. With a proper counterweight the power required on the upstroke will be substantially the same as the power required on the downstroke and the power requirements will be substantially constant throughout the stroke. Switching means is connected between a hydraulic pump and the first and second assemblies for alternately supplying hydraulic fluid to and from the first and second assemblies.

And a further object of the present invention is the provision of providing a check valve between the hydraulic pump and the hydraulic connection between the first and second assemblies for replenishing the hydraulic fluid as required.

A still further object of the present invention is the provision of a valve connected between the first hydraulic assembly and the hydraulic connection between the assemblies. The valve is normally closed but is actuated to the open position by pressure in the hydraulic connection whereby failure in the hydraulic connection will not allow the first assembly to drop the pump load.

Yet a still further object of the present invention is the provision in the fluid return line between the switching means and the hydraulic pump of a valve which is normally closed but is actuated in the open position by pressure from the hydraulic pump and closes in the event that the pump stops. An orifice valve is provided in parallel with the valve thereby preventing free fall of the pump load in the event that the hydraulic pump is stopped.

Another object of the present invention is the provision of control means for insuring a supply of hydraulic fluid in the connection between the first and second assemblies for preventing actuation of the check valve on each stroke.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
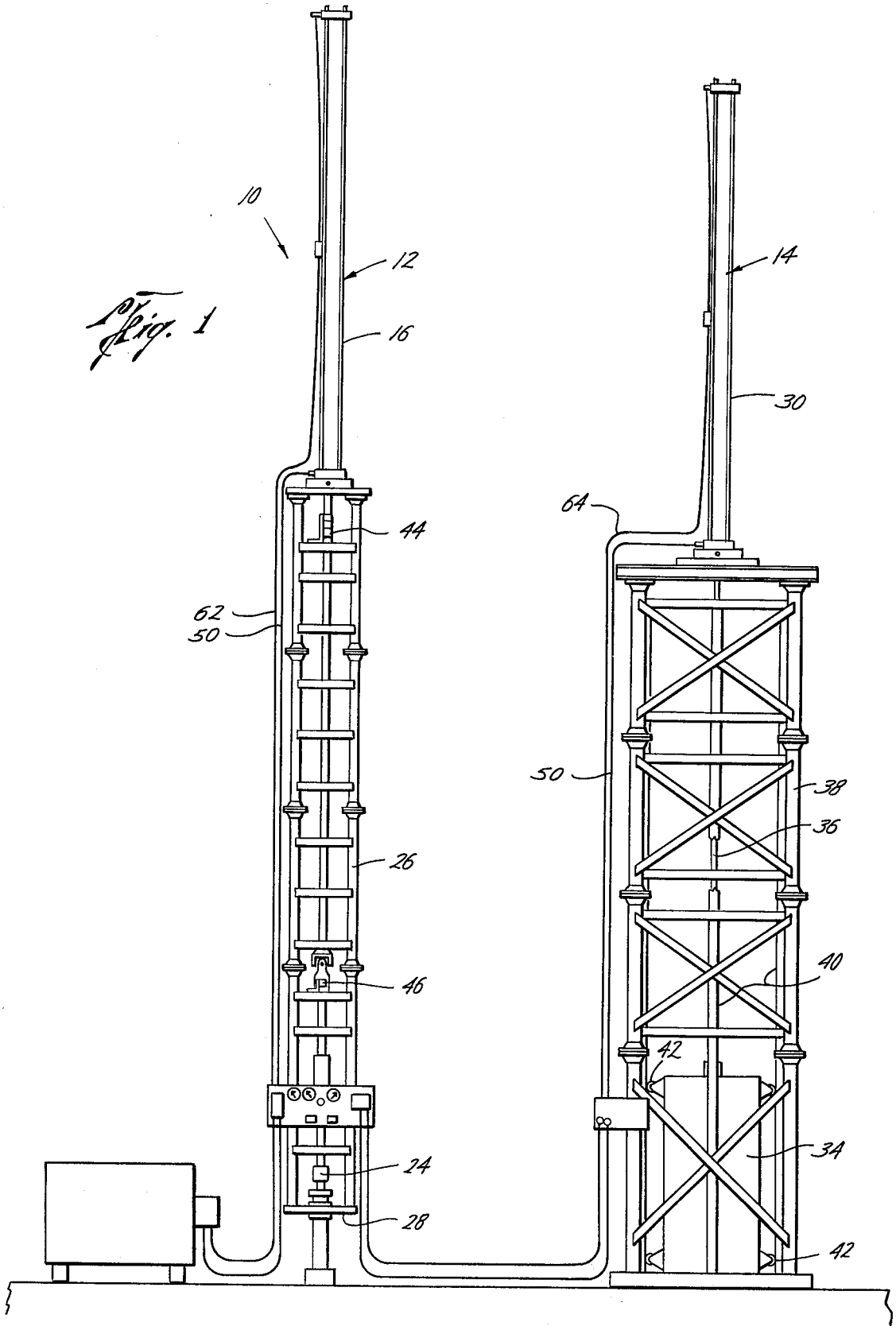
FIG. 1 is an elevational view of the hydraulic pumping unit of the present invention.
Figure 2:
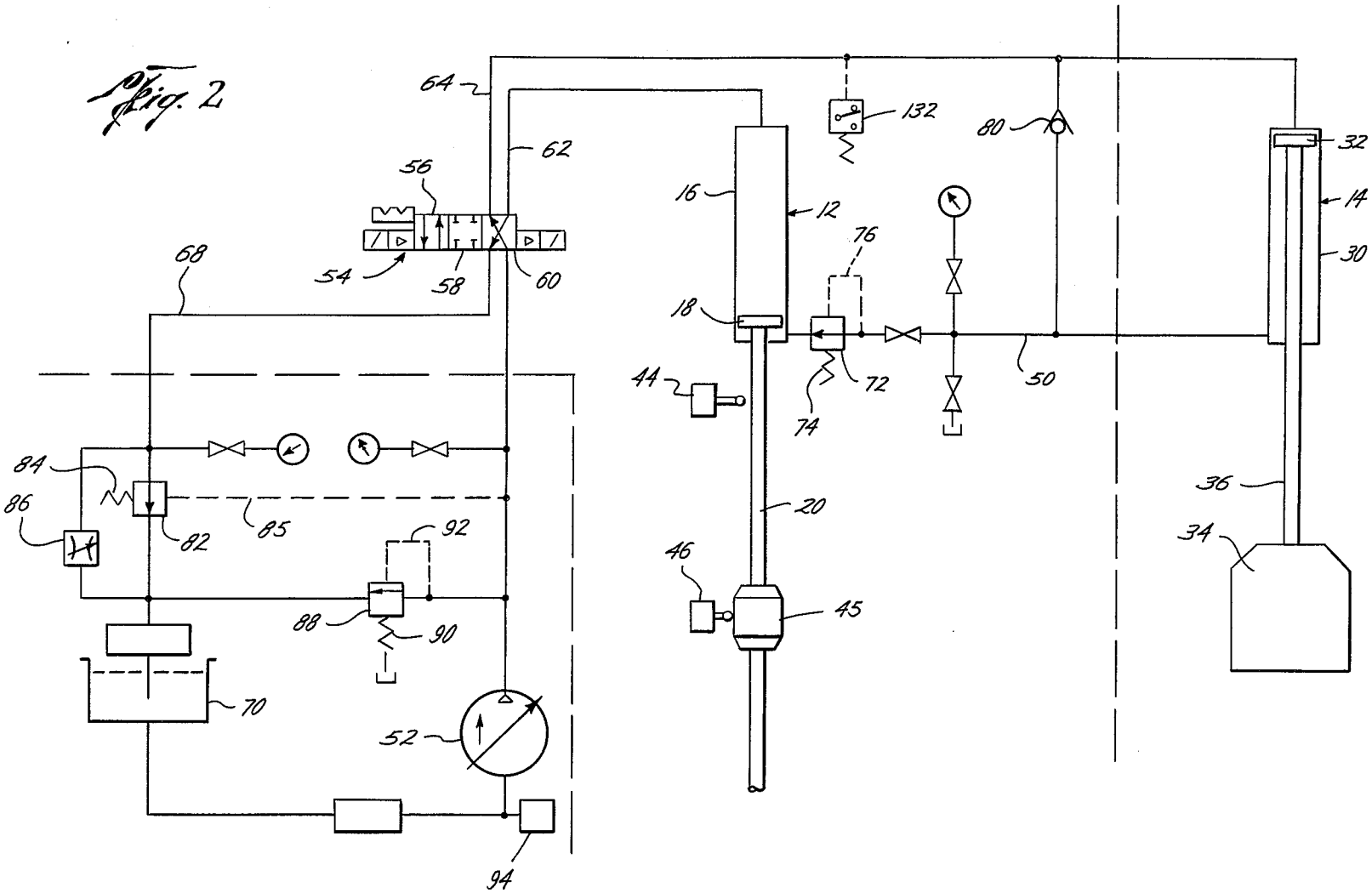
FIG. 2 is a hydraulic schematic of the apparatus shown in FIG. 1.

Referring now to the drawings, and particularly to FIGS. 1 and 2, the reference numeral 10 generally indicates the hydraulic pumping unit of the present invention which generally includes a first vertically positioned hydraulic piston and cylinder assembly 12 and a second vertically positioned hydraulic piston and cylinder assembly 14. The first assembly 12 is the actual pumping unit for vertically reciprocating a downhole well pump and the second assembly 14 is connected to a counterbalance weight for counterbalancing the first assembly 12.

The assembly 12 includes a cylinder 16 and a piston 18 movable therein, one of which, such as piston 18, is adapted to be connected to a downhole pump (not shown) such as by piston rod 20 whereby the piston as it is reciprocated lifts a polished rod 24 which is in turn connected to and lifts the rod string and downhole pump plunger. The assembly 12 is suitably supported by a support structure 26 from the wellhead 28.

The assembly 14 includes a cylinder 30 and piston 32 reciprocable therein, and one of which, such as piston 32, is connected to a counterweight 34 through the piston rod 36. The assembly 14 is suitably supported from a support 38 in which the counterweight 34 moves vertically on rails 40 by coacting guide rollers 42.

A cam 45 is connected to piston rod 20 of assembly 12 and an upper limit switch 44 and a lower limit switch 46 are connected to the support 26 for actuation by the cam 45 as the piston 18 alternately moves upwardly and downwardly when actuating the downhole pump. A first hydraulic connection or first line 50 is connected between the first and second assemblies 12 and 14 for allowing the counterweight 34 to hydraulically counterbalance the load carried by the assembly 12. Thus the line 50 is connected between the cylinder 16 and the cylinder 30 at a location below said pistons 18 and 32, respectively, whereby downward movement of one of the pistons causes upward movement of the other piston.

Referring now to FIG. 2, a hydraulic pump 52 is provided which is connected to a switching means 54 which in turn is connected to the assemblies 12 and 14 for alternately supplying hydraulic fluid to and from the first and second assemblies 12 and 14. The switching means 54 may be a solenoid operated shuttle valve having positions 56, 58, and 60. A second hydraulic line 62 is connected between the switching means 54 and the cylinder 16 at a location above the piston 18. A third hydraulic line 64 is connected between the switching means 54 and the cylinder 30 at a position above the piston 32.

With the apparatus 10 in the position shown in FIG. 2, the piston 18 is at its lowermost extent of travel and the cam 45 has actuated the lower limit switch 46. With piston 18 in the lowermost position, the piston 32 of the second assembly 14 and the counterweights 34 would be at their uppermost position as shown. The actuation of the lower limit switch 46 causes the switching means 54 to be set with position 60 in communication between the pump 52 and the hydraulic lines 62 and 64 thereby directing fluid from the pump 52 through the line 64 to the top of the cylinder 30 and allowing fluid from the top of the cylinder 16 to exhaust through line 62 and through a return line 68 to a fluid reservoir 70.

The hydraulic pump 52 will pump fluid into the top of the cylinder 30 which will force the piston 32 and weight 34 downwardly. The fluid in the cylinder 30 beneath the piston 32 is forced through hydraulic line 50 into the bottom of cylinder 12 beneath the piston 18 to raise the piston 18 which in turn will cause piston rod 20, polished rod 24 and the plunger of the downhole pump to rise which brings well fluid to the surface. When cam 45 rises far enough, it actuates upper limit switch 44, causing shuttle valve 54 to move to place position 56 in communication between the pump 52 and return line 68 and the lines 62 and 64. The output of fluid from pump 52 is then directed to the top of cylinder 16 through line 62 and allowing fluid from the top of cylinder 30 to exhaust through lines 64 and 68 to the reservoir 70. This cycle causes the counterweight 34 to rise which stores energy which will be returned to the system on the next cycle.

This structure and operation allows the pump 52 to operate at relatively low pressures, for example, 300–700 psi, while the pressures below the pistons 18 and 32 and in the hydraulic connection 50 are much higher, for example, 2000–3000 psi. By properly selecting the mass of the counterweight 34, for example, as great as the mass of the structure connected to the piston 18, and preferably equal to the mass of the weight connected to the piston 18 plus one-half of the fluid load of the fluid pump, the power required on the upstroke will be approximately the same as the power required on the downstroke. Aside from frictional losses, the only energy needed is that required to lift fluid from the well. Furthermore, the vertically moving counterweight 34 provides a linearly moving counterweight whereby the load presented to the prime mover will be linearly and not cyclic thereby allowing the use of a smaller pump motor.

In addition, the specific hydraulic and electrical control circuitry provides reliable control and actuation of the pumping unit 10. Referring still to FIG. 2, a valve 72 is connected between the first line 50 and the cylinder 16 and is biased to a closed position by a spring 74 but is actuated to the open position shown by a pressure line 76 connected to the first hydraulic line 50. Therefore, so long as pressure is present in the line 50, the valve 72 remains open. However, in the event of a break or failure in the line 50, the valve 72 will close preventing free fall of the first piston 18 and its connected load thereby preventing damage.

In addition, in normal usage, hydraulic fluid from the high pressure line 50 will leak past the pistons 18 and 32 thereby deplenishing the hydraulic fluid in line 50. The line 50 can be suitably replenished by connecting a check valve 80 between lines 64 leading to the top of cylinder 30 and the line 50 for replenishing fluid in the high pressure line 50 and beneath the pistons 18 and 32 as needed. That is, assuming that hydraulic fluid is needed in line 50 hydraulic fluid will be pumped from pump 52 through line 64 into the top of cylinder 30 to move the piston 32 and counterweight 34 downwardly, but in the event there is not sufficient hydraulic fluid in line 50 the piston 18 and its load will not completely rise. Therefore, the pressure in line 64 is increased sufficiently to move through the check valve 80 into the line 50 in order to raise the piston 18 and cause cam 45 to move upwardly a sufficient distance to contact limit switch 44 at which time the line 50 is filled, the switching means 54 is reversed and the check valve 80 closes.

In the return line 68, a return valve 82 is provided which is biased by a spring 84 to a normally closed position but is held in the open position by a pressure line 85 connected to the outlet pressure of the pump 52. An orifice valve 86 is connected in parallel with the pressure actuated valve 82. There are some occasions when the hydraulic pump 52 may be shut off such as in the case of an oil well having a "pump-off" controller, and in that event it is possible that with the cession of fluid output from the pump 52 the piston 18 and its connected load may be subject to a free fall which would damage the equipment. Therefore, the valve 82 will close in the event that the pump 52 stops thereby limiting return flow through the return line 68 through the orifice 86 which will limit the flow of return fluid thereby preventing the possibility of a free fall of the downhole pumping load.

In addition, a suitable relief valve 88 may be provided which is biased by a spring 90 to a normally closed position and is connected by a pressure line 92 to the outlet of the pump 52 and is therefore actuated to bypass fluid from the pump 52 to the reservoir 70 in the event of an overpressure in the outlet connection or pressure connection of the pump 52. And a standard vacuum switch 94 may be connected to the input of the pump 52 as a safety device to shut down the pump 52 in the event that a vacuum occurs which would cause damage to the pump 52.

Figure 3:
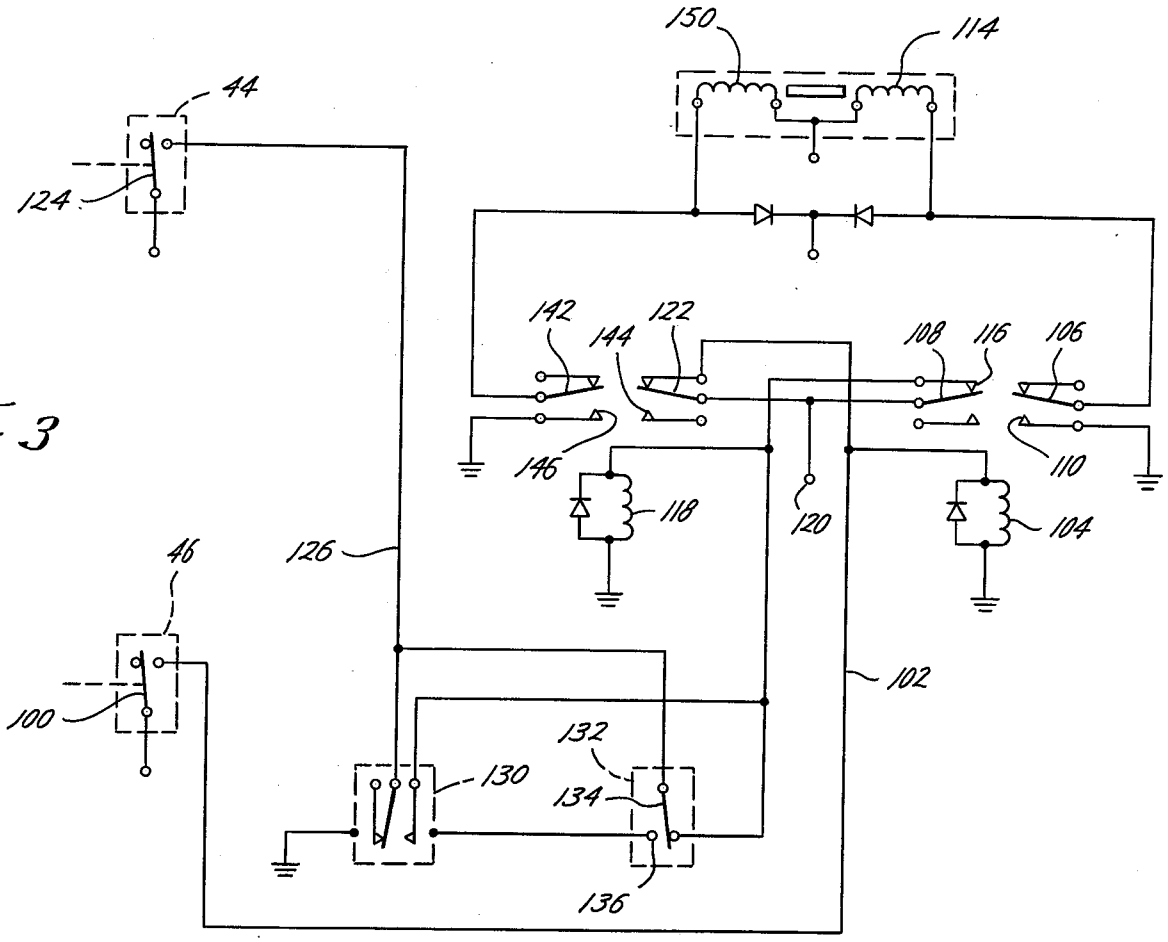
FIG. 3 is an electrical schematic for actuation and control of the apparatus shown in FIG. 1.

Referring now to FIG. 3, an electrical schematic of the electrical control system is best seen. When the cam 45 moves to its lower position, it contacts and energizes the lower limit switch 46 which moves the electrical switch 100 from the normally open position to the closed position to provide a power supply on line 102 to energize relay 104. Energization of relay 104 actuates switches 106 and 108. Movement of the switch 106 to the contact 110 provides a circuit through line 112 to energize the up solenoid coil 114 on shuttle valve 54 (FIG. 2) to move the shuttle valve 60 into position between the pump 52 and lines 62 and 64. In addition, the movement of switch 108 away from contact 116 de-energizes relay 118 which had previously been energized for moving the cam 45 downwardly. Therefore, with relay 104 energized, fluid from pump 52 is pumped through position 60 of the valve 54 and into line 64 to the top of cylinder 30 moving the piston 32 downwardly and moving the piston 18 upwardly carrying the cam 45 upwardly.

Even though lower limit switch 46 opens, the relay 104 is kept energized from power supply 120 through switch 122 as the cam 45 moves upwardly. When the cam 45 reaches the upper limit switch 44, a switch 124 is actuated to supply power to line 126. While power from line 126 can be used to directly actuate relay 118 to reverse the cycle, an additional time delay switch 130 and pressure switch 132 may be provided in order to prevent unnecessarily actuating and wearing out the check valve 80. That is, fluid may leak by the pistons 18 and 32 to a slight extent on each cycle in which case the check valve 80 would be actuated during each cycle to replenish oil from the line 64 to the high pressure line 50 until the cam 45 engages the upper limit switch 44.

However, in order to prevent actuation of the check valve 80 on each cycle, a pressure switch 132 is provided (FIGS. 2 and 3) which is connected to line 64 and actuated to move electrical switch 134 to engage contact 136 when the pressure in line 64 reaches a predetermined amount, such as 1000 pounds, thereby indicating that the piston 18 is near the top of its extent of travel and thereby in turn energizing the time delay switch 130 which after a set time delay, for example from 0.6–60 seconds is actuated to apply power to relay 118. Thus it is noted that the cam 45 will move upwardly past the upper limit switch 44 a predetermined time delay to provide an excess of hydraulic fluid under the piston 18 which insures that the check valve 80 need not be actuated each cycle but only when the fluid in line 50 becomes so low that the cam 45 fails to reach the upper limit switch 44. Actuation of the relay 18 moves electrical switches 122 and 142 to contacts 144 and 146, respectively. The movement of switch 122 de-energizes up relay 104. The movement of switch 142 energizes the down coil 150 of solenoid shuttle valve 54 causing the cycle to reverse.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic pumping unit for vertically actuating a downhole pump comprising, a first vertically positioned hydraulic piston and cylinder assembly, said piston having a piston rod adapted to be connected to said pump for actuating said pump, a second vertically positioned hydraulic piston and cylinder assembly, said second piston having a piston rod, a vertically movable weight connected to the piston rod of the second piston, a first hydraulic line connected between the first and second cylinders at a position below said first and second pistons whereby downwardly movement of one piston causes upward movement of the other piston, a hydraulic pump, switching means connected between hydraulic pump and said first and second cylinders for alternately supplying hydraulic fluid to and from said first and second cylinders above said pistons whereby downward movement of the first piston stores energy in the second assembly for assisting in moving the first piston upwardly, and a valve connected between said first cylinder and said first hydraulic line which is normally closed but actuated to an open position by the pressure in the first hydraulic line whereby a failure in the first line will not allow free fall of the first piston.

2. A hydraulic pumping unit for vertically actuating a downhole pump comprising, a first vertically positioned hydraulic piston and cylinder assembly, said piston having a piston rod adapted to be connected to said pump for actuating said pump, a second vertically positioned hydraulic piston and cylinder assembly, said second piston having a piston rod, a vertically movable weight connected to the piston rod of the second piston, a first hydraulic line connected between the first and second cylinders at a position below said first and second pistons whereby downwardly movement of one piston causes upward movement of the other piston, a hydraulic pump, switching means connected between hydraulic pump and said first and second cylinders for alternately supplying hydraulic fluid to and from said first and second cylinders above said pistons whereby downward movement of the first piston stores energy in the second assembly for assisting in moving the first piston upwardly, a fluid return line between said switching means and said hydraulic pump, a first valve in said return line which is normally closed but actuated to the open position by pressure from the hydraulic pump outlet whereby said first valve closes in the event the pump stops, and an orifice valve in parallel with the first valve whereby preventing free fall of the first piston in the event the pump is stopped.

3. A hydraulic pumping unit for vertically reciprocating a downhole pump comprising, a first vertically positioned hydraulic piston and cylinder assembly, said piston having a piston rod adapted to be connected to said pump for actuating said pump, a second vertically positioned hydraulic piston and cylinder assembly, said second piston having a piston rod, a vertically movable weight connected to the piston rod of the second piston, a first hydraulic line connected between the first and second cylinders at a position below said first and second pistons whereby downward movement of one piston causes upward movement of the other piston, a hydraulic pump, second and third hydraulic lines connected to said first and second cylinders, respectively, above said pistons for transmitting hydraulic fluid to and from said cylinders, switching means connected between said hydraulic pump and said second and third hydraulic lines for alternately supplying hydraulic fluid to and from said first and second cylinders whereby downward movement of the first piston stores energy in the second assembly for assisting in moving the first piston upwardly, a cam connected to the piston rod of the first piston, upper and lower limit switches vertically positioned for actuation by said cam as the first piston reciprocates for actuating said switching means, and a check valve connected between said first and third hydraulic lines for replenishing said first hydraulic line with fluid.

4. The apparatus of claim 3 including, a pressure switch connected between the switching means and the second cylinder and actuated upon a predetermined high pressure, a timing switch connected to said upper limit switch and said pressure switch and actuated upon actuation of both the upper limit switch and pressure switch, said timing switch connected to and actuating said switching means whereby fluid is continued to be supplied to the second cylinder after the actuation of the upper limit switch for preventing actuation of the check valve on each stroke.

5. The apparatus of claim 3 including, a valve connected between said first cylinder and said first hydraulic line which is normally closed but actuated to an open position by the pressure in the first hydraulic line whereby a failure in the first line will not allow free fall of the first piston.

6. The apparatus of claim 3 including, a fluid return line between said switching means and said hydraulic pump, a first valve in said return line which is normally closed but actuated to the open position by pressure from the hydraulic pump outlet whereby said first valve closes in the event the pump stops, and an orifice valve in parallel with the first valve thereby preventing free fall of the first piston in the event the pump is stopped.

* * * * *